US011204043B2

(12) United States Patent
Gu et al.

(10) Patent No.: US 11,204,043 B2
(45) Date of Patent: Dec. 21, 2021

(54) CENTRIFUGAL FAN AND AIR SUPPLY DEVICE HAVING THE SAME

(71) Applicant: Nidec Corporation, Kyoto (JP)

(72) Inventors: Zhaowu Gu, Kyoto (JP); Atsushi Michishita, Kyoto (JP)

(73) Assignee: NIDEC CORPORATION, Kyoto (JP)

( * ) Notice: Subject to any disclaimer, the term of this patent is extended or adjusted under 35 U.S.C. 154(b) by 225 days.

(21) Appl. No.: 16/239,567

(22) Filed: Jan. 4, 2019

(65) Prior Publication Data

US 2019/0234429 A1 Aug. 1, 2019

(30) Foreign Application Priority Data

Jan. 31, 2018 (CN) ..... 201810093632.5

(51) Int. Cl.

| | |
|---|---|
| ***F04D 29/70*** | (2006.01) |
| ***F04D 25/06*** | (2006.01) |
| ***F04D 29/42*** | (2006.01) |

(52) U.S. Cl.

CPC ..... *F04D 29/706* (2013.01); *F04D 25/06* (2013.01); *F04D 25/0613* (2013.01); *F04D 29/4226* (2013.01); *F05B 2240/14* (2013.01); *F05B 2260/602* (2013.01); *F05D 2260/602* (2013.01); *F05D 2260/605* (2013.01); *F05D 2260/608* (2013.01)

(58) Field of Classification Search

CPC .. F04D 25/06; F04D 25/0606; F04D 29/4226; F04D 29/706; F05B 2260/602; F05D 2260/602; F05D 2260/605; F05D 2260/608

See application file for complete search history.

(56) References Cited

U.S. PATENT DOCUMENTS 5,620,302 A * 4/1997 Garrison ..... F23L 17/005 415/169.2
2002/0025261 A1* 2/2002 Kudo ..... F04D 29/083 417/354

FOREIGN PATENT DOCUMENTS

| | | | |
|---|---|---|---|
| CN | 107614884 A | | 1/2018 |
| DE | 102015202946 | * | 8/2016 |
| DE | 20 2018106943 | * | 8/2019 |
| EP | 3 312 431 A1 | | 4/2018 |
| JP | 2002-106500 A | | 4/2002 |
| JP | 2002-130188 A | | 5/2002 |
| JP | 2008-089262 A | | 4/2008 |
| JP | 2016-075243 A | | 5/2016 |

* cited by examiner

*Primary Examiner* — Charles G Freay
(74) *Attorney, Agent, or Firm* — Keating & Bennett

(57) ABSTRACT

A centrifugal fan includes a water outlet connecting an interior and an exterior of a housing at a position closer to a radially inner side than an impeller such that liquid at a bottom of the housing is able to be discharged quickly, and accumulation of the liquid is avoided, to ensure normal operation of the centrifugal fan.

16 Claims, 5 Drawing Sheets

CENTRIFUGAL FAN AND AIR SUPPLY DEVICE HAVING THE SAME

CROSS REFERENCE TO RELATED APPLICATIONS

This application claims the benefit of priority to Chinese Patent Application No. 201810093632.5 filed on Jan. 31, 2018. The entire contents of this application are hereby incorporated herein by reference.

BACKGROUND OF THE INVENTION

1. Field of Invention

This disclosure relates to the electromechanical field, and in particular to a centrifugal fan and air supply device including a centrifugal fan.

2. Description of the Related Art

In recent years, with the improvement of living standards, people have higher requirements on functions and performances of household appliances. Wherein, some refrigeration equipment requires use of centrifugal fans, such as ice machines, refrigerators, and the like.

It should be noted that the above description of the background is merely provided for clear and complete explanation of this disclosure and for easy understanding by those skilled in the art. And it should not be understood that the above technical solution is known to those skilled in the art as it is described in the background of this disclosure.

SUMMARY OF THE INVENTION

However, since such refrigeration equipment as an ice maker, and a refrigerator, etc., needs to work at a low temperature, in order to prevent vanes from being frozen, there should be no accumulation of liquid, such as water, in the centrifugal fan, otherwise, the normal operation of the centrifugal fan will be affected.

In order to solve the above problem, exemplary embodiments of this disclosure provide a centrifugal fan and air supply device including a centrifugal fan, in which by providing a water outlet connecting an interior and an exterior of a housing at a position closer to a radially inner side than an impeller, liquid at a bottom of the housing is able to be discharged quickly, and accumulation of the liquid is able to be avoided, to ensure normal operation of the centrifugal fan. And furthermore, the water outlet is able to be defined by a simple construction and process.

According to a first aspect of the exemplary embodiments of this disclosure, there is provided a centrifugal fan, including an impeller rotatable about a central axis and including multiple vanes; a motor located at a radially inner side of the impeller to drive the impeller; and a housing accommodating the impeller, the housing including a first housing and a second housing, the first housing including an axially opened air supply aperture at a radially outer side of the impeller, and the second housing including a base extending in a direction perpendicular or substantially perpendicular to an axial direction of the central axis; the base includes at least one first water outlet connecting an interior and an exterior of the housing located at a position closer to the radially inner side than the impeller.

According to a second aspect of the exemplary embodiments of this disclosure, the base includes multiple first water outlets along a circumference of the base.

According to a third aspect of the exemplary embodiments of this disclosure, the multiple first water outlets are evenly distributed along the circumference of the base.

According to a fourth aspect of the exemplary embodiments of this disclosure, in the axial direction, the first water outlet has a sectional shape of a rectangle, or a triangle, or a trapezoid.

According to a fifth aspect of the exemplary embodiments of this disclosure, the base further includes a platform supporting the motor and a first groove at a radial outer side of an outer circumference of the platform, the first water outlet being provided at an intersection of the platform and the first groove.

According to a sixth aspect of the embodiments of this disclosure, the base further includes a circumference at a radial outer side of the first groove, in the axial direction, the platform being located at an outer side of the housing relative to the circumference, and the first groove being located at an inner side of the housing relative to the circumference.

According to a seventh aspect of the exemplary embodiments of this disclosure, in the axial direction, a height of the first groove is uneven relative to the platform.

According to an eighth aspect of the exemplary embodiments of this disclosure, a surface of the first groove facing the inner side of the housing includes a plane and a slope.

According to a ninth aspect of the exemplary embodiments of this disclosure, the second housing further includes a wall extending from an outer circumference of the base in the axial direction, at least one second water outlet being provided at an end of the wall away from the base.

According to a tenth aspect of the exemplary embodiments of this disclosure, the impeller further includes: a cup accommodating the motor; a lower plate extending radially outside from an outer circumferential edge of the cup; and an impeller extending in the axial direction from the lower plate; in the axial direction, a circuit board between the second housing and the cup, and an outer surface of the circuit board being covered by a water-proof glue.

According to an eleventh aspect of the exemplary embodiments of this disclosure, the vanes, the lower board and the impeller are integrally provided.

According to a twelfth aspect of the exemplary embodiments of this disclosure, the second housing further includes a guide leading a wire to the exterior of the housing.

According to a thirteenth aspect of the exemplary embodiments of this disclosure, the base further includes an opening, and the guide includes: a second groove in a surface of the base facing the outer side of the housing and radially extending outside from the opening; and a first group of hooks including two hook-shaped components and provided on the wall extending from the outer circumference of the base in the axial direction.

According to a fourteenth aspect of the exemplary embodiments of this disclosure, the guide further includes: a second group of hooks including two hook-shaped components and provided on the wall, the second group of hooks and the first group of hooks being provided at different positions in a circumferential direction of the second housing.

According to a fifteenth aspect of the exemplary embodiments of this disclosure, a section of an outer circumference of the air supply apertures of the first housing in the axial direction has a shape including an arc.

According to a sixteenth aspect of the exemplary embodiments of this disclosure, the centrifugal fan further includes a bearing accommodation that is integral with the second housing.

According to a seventeenth aspect of the exemplary embodiments of this disclosure, there is provided an air supply device, including the centrifugal fan as described in any one of the first to the sixteenth aspects.

With reference to the following description and drawings, the particular exemplary embodiments of this disclosure are disclosed in detail, and the principles of this disclosure and the manners of use are indicated. It should be understood that the scope of the exemplary embodiments of this disclosure is not limited thereto. The exemplary embodiments of this disclosure contain many alternatives, modifications and equivalents within the scope of the terms of the appended claims.

Features that are described and/or illustrated with respect to one exemplary embodiment may be used in the same way or in a similar way in one or more other exemplary embodiments and/or in combination with or instead of the features of the other exemplary embodiments.

It should be emphasized that the term "comprises/comprising/includes/including" when used in this specification is taken to specify the presence of stated features, integers, steps or components but does not preclude the presence or addition of one or more other features, integers, steps, components or groups thereof.

BRIEF DESCRIPTION OF THE DRAWINGS

These and further aspects and features of the present disclosure will be apparent with reference to the following description and attached drawings.

DETAILED DESCRIPTION OF THE PREFERRED EMBODIMENTS

These and further aspects and features of the present disclosure will be apparent with reference to the following description and attached drawings. In the description and drawings, particular embodiments of the disclosure have been disclosed in detail as being indicative of some of the ways in which the principles of the disclosure may be employed, but it is understood that the disclosure is not limited correspondingly in scope. Rather, the disclosure includes all changes, modifications and equivalents coming within the terms of the appended claims.

In this disclosure, a direction parallel to a direction extending along a central axis is referred to as "an axial direction", and a direction of radius centered on the central axis is referred to as "a radial direction". It is to be noted that various directions in this disclosure are defined only for the convenience of description of the embodiments of this disclosure, and directions in use and manufacture of the centrifugal fan and the air supply device are not limited.

The centrifugal fan and the air supply device of the embodiments of this disclosure shall be described below with reference to the accompanying drawings.

Figure 1:
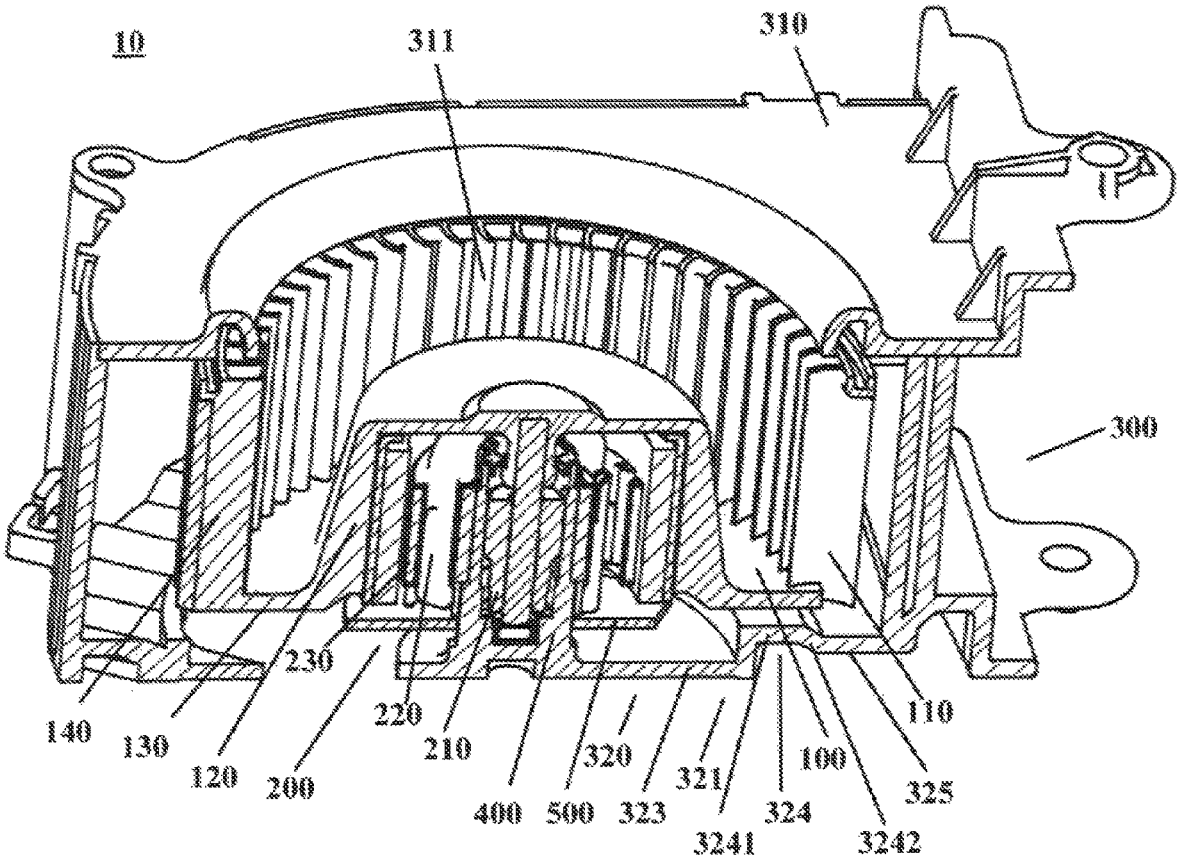
FIG. 1 is a space diagram of a sectional structure of the centrifugal fan of Embodiment 1 of this disclosure.
Figure 2:
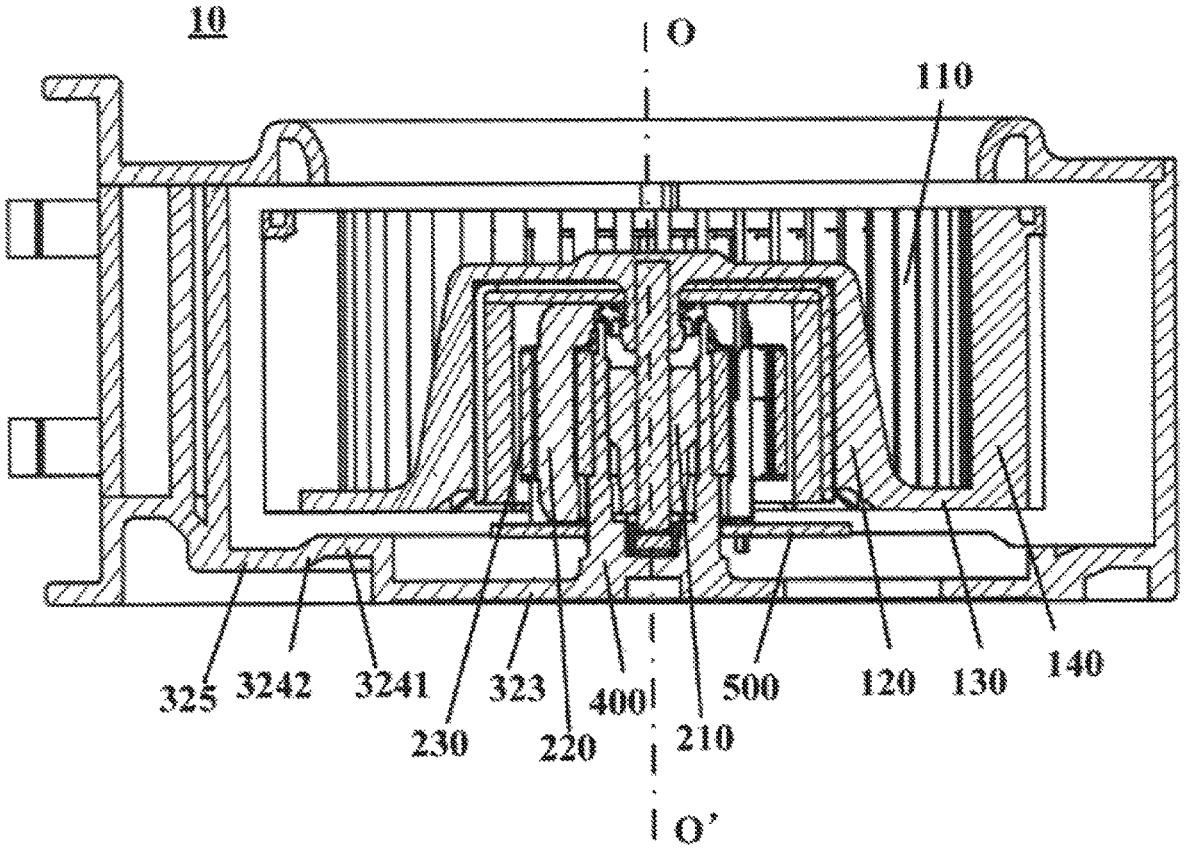
FIG. 2 is a sectional view of the centrifugal fan of Embodiment 1 of this disclosure.
Figure 3:
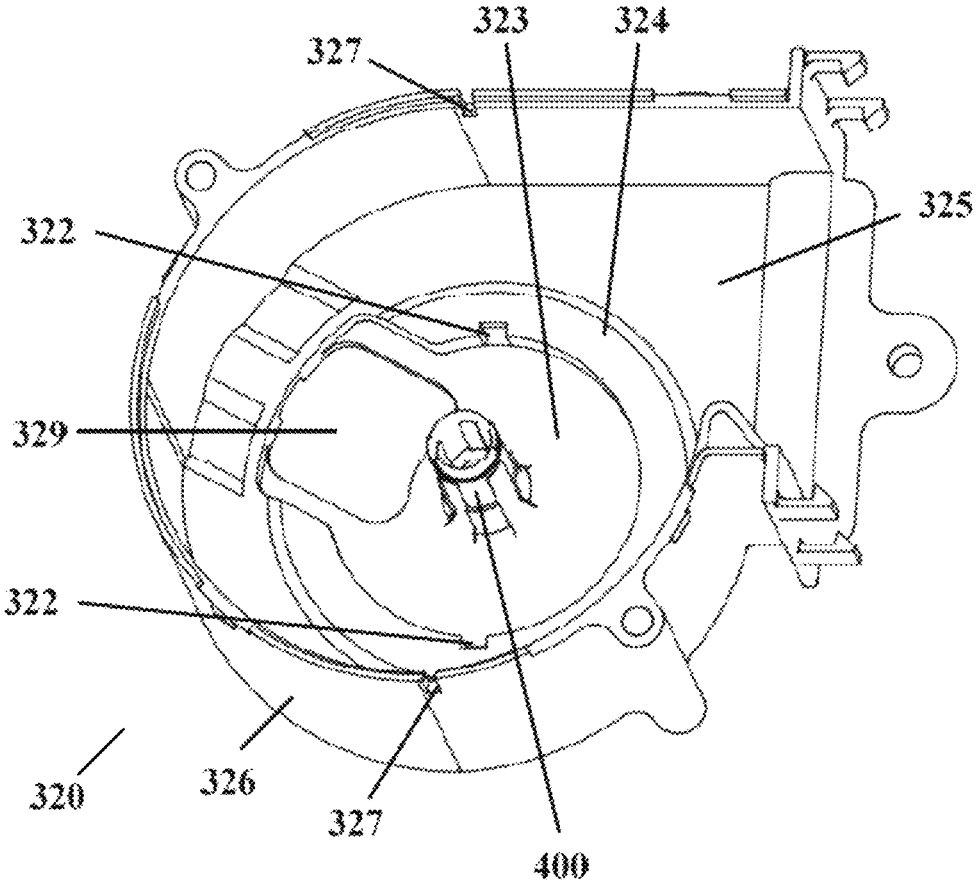
FIG. 3 is a space diagram of a top angle of view of the second housing of the centrifugal fan of Embodiment 1 of this disclosure.
Figure 4:
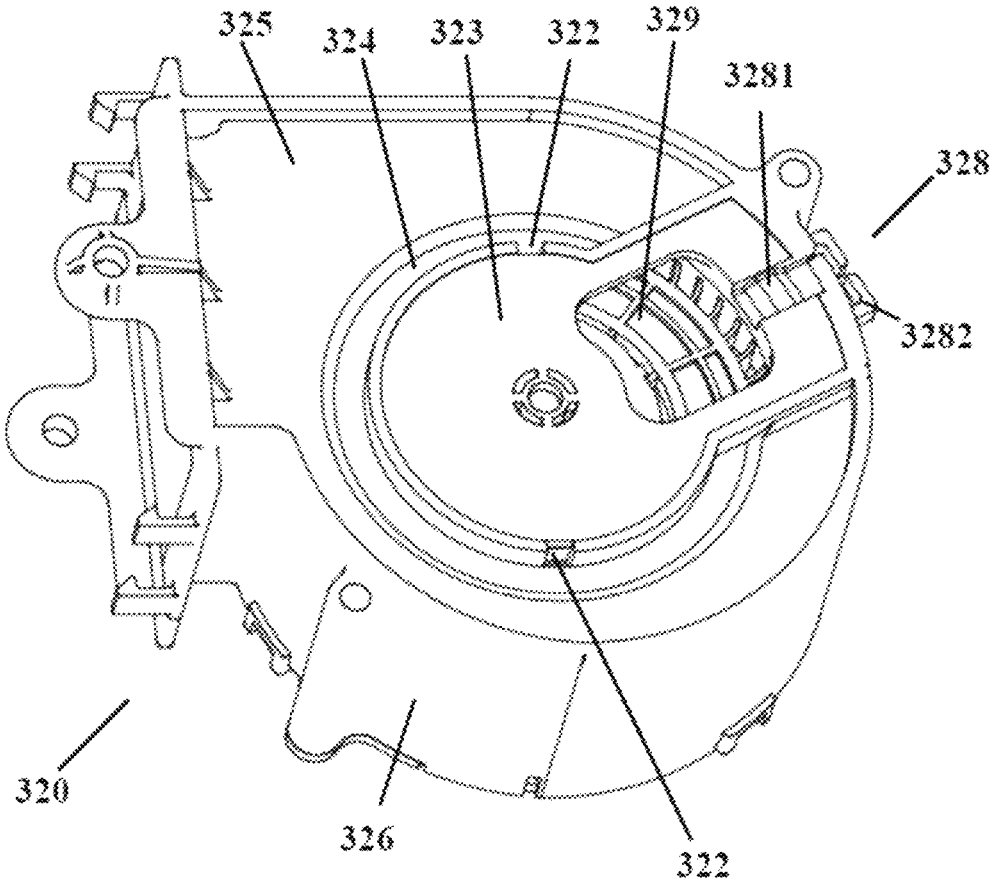
FIG. 4 is a space diagram of a bottom angle of view of the second housing of the centrifugal fan of Embodiment 1 of this disclosure.

Embodiment 1 of this disclosure provides a centrifugal fan. FIG. 1 is a space diagram of a sectional structure of the centrifugal fan of Embodiment 1 of this disclosure, FIG. 2 is a sectional view of the centrifugal fan of Embodiment 1 of this disclosure, FIG. 3 is a space diagram of a top angle of view of the second housing of the centrifugal fan of Embodiment 1 of this disclosure, and FIG. 4 is a space diagram of a bottom angle of view of the second housing of the centrifugal fan of Embodiment 1 of this disclosure.

As shown in FIGS. 1-4, the centrifugal fan 10 includes: an impeller 100 rotating by taking a central axis OO' as a center and having multiple vanes 110; a motor 200 located at a radially inner side of the impeller 100 and driving the impeller 100; and a housing 300 accommodating the impeller 100; wherein, the housing 300 includes a first housing 310 and a second housing 320, the first housing 310 having an axially opened air supply aperture 311 at a radially outer side of the impeller 100, and the second 320 housing having a base 321 extending in a direction perpendicular to an axial direction of the central axis OO', the base 321 including at least one first water outlet 322 connecting an interior and an exterior of the housing 300 located at a position closer to the radially inner side than the impeller 110.

Hence, by providing the water outlet 322 connecting the interior and the exterior of the housing 300 at the position closer to the radially inner side than the impeller 100, liquid at a bottom of the housing 300 may be discharged quickly, and accumulation of the liquid may be avoided, thereby ensuring normal operation of the centrifugal fan 10. And furthermore, the water outlet 322 may be formed through simple construction, and a process is simple.

In this embodiment, "the axial direction" refers to a direction parallel to a direction extending along the central axis OO', "the radial direction" refers to a direction of radius centered on the central axis, "the radially outer side" refers to a side in the radial direction and away from the central axis OO', "the radially inner side" refers to a side in the radial direction and close to the central axis OO', and "a direction of circumference" refers to a direction along a circumference, such as a circumferential direction.

In this embodiment, reference may be made to the prior art for a structure of the motor 200. For example, the motor 200 may include a bearing 210, a coil 220 and a magnet 230 sequentially from the radial inner side to the radial outer side.

In this embodiment, the centrifugal fan 10 may further include a bearing accommodation portion 400 for accommodating the bearing 210.

The bearing accommodation portion 400 and the second housing 320 may be integrally shaped, thereby simplifying processes of manufacture and installation.

In this embodiment, as shown in FIG. 1, a section of an outer circumference of the air supply aperture 311 of the first housing 310 in the axial direction may have a shape including an arc. Hence, a pressure of an air flow may be increased, and occurrence of turbulence may be avoided, thereby lowering noises of the fan.

In this embodiment, the base 321 may include one first water outlet 322 or multiple first water outlets 322. And these multiple first water outlets 322 may be configured along a circumference of the base 321.

In this embodiment, multiple first water outlets 322 may be evenly distributed along the circumference of the base 321. For example, the even distribution may be approximately even distribution.

In this way, the multiple first water outlets 322 may be equally distributed in the circumferential direction of the base 321 at positions closer to a radial inner side than the impeller 110, to be able to further improve a draining effect.

For example, as shown in FIG. 3, the base 321 includes two first water outlets 322, which may be symmetrically disposed in the circumferential direction of the base 321.

In this embodiment, shapes of the first water outlets 322 may be designed as actually demanded.

For example, in the axial direction, the first water outlet 322 may have a sectional shape of a rectangle, or a triangle, or a trapezoid.

In this embodiment, as shown in FIGS. 1-4, the base 321 may further have a platform portion 323 supporting the motor 200 and a first groove portion 324 formed at a radial outer side of an outer circumference of the platform portion 323, the first water outlets 322 being provided at an intersection of the platform portion 323 and the first groove portion 324.

In this embodiment, as shown in FIGS. 1-4, the base 321 may further have circumference portion 325 provided at a radial outer side of the first groove portion 324. And as shown in FIG. 2, in the axial direction, the platform portion 323 is located at an outer side of the housing 300 relative to the circumference portion 325, and the first groove portion 324 is located at an inner side of the housing 300 relative to the circumference portion 325.

In this embodiment, the first groove portion 324 protrudes towards the inner side of the housing 300, and the platform portion 323 protrudes towards the outer side of the housing 300. That is, as shown in FIG. 1, in the axial direction, the first groove portion 324, the circumference portion 325 and the platform portion 323 are disposed from top to bottom.

Hence, by arranging the first water outlets 322 at the intersection of the platform portion 323 and the first groove portion 324 having an obvious height difference therebetween, the draining effect may further be improved.

And furthermore, by forming the platform portion 323 and the first groove portion 324 having the obvious height difference therebetween, occurrence of turbulence may be avoided.

In this embodiment, in the axial direction, a height of the first groove portion 324 may be uneven relative to the platform portion 323. For example, the height of the first groove portion 324 is uneven relative to a surface of the first groove portion 324 facing the inner side of the housing 300 (an upper surface in FIGS. 1 and 2).

For example, as shown in FIGS. 1 and 2, the surface of the first groove portion 324 facing the inner side of the housing 300 (the upper surface in FIGS. 1 and 2) may include a plane 3241 and a slope 3242.

In this embodiment, the slope 3242 may be disposed at a radially outer side of the plane 3241, and may also be disposed at a radially inner side of the plane 3241.

In this way, by setting the surface of the first groove portion 324 facing the inner side of the housing 300 relative to the platform portion 323 to be uneven in height, such liquid as water, etc. within the housing may be made to fall rapidly to the bottom of the housing, thereby further improving the draining effect.

In this embodiment, as shown in FIG. 3, the second housing 320 may further have a wall portion 326 extending from an outer circumference of the base 321 in the axial direction, at least one second water outlet 327 being provided at an end portion (an upper end in FIG. 3) of the wall portion 326 away from the base 321.

Hence, by providing at least one second water outlet 327 at the end portion of the wall portion 326 away from the base 321, the draining effect may further be improved.

In this embodiment, multiple second water outlets 327 may be provided. For example, multiple second water outlets 327 may be evenly disposed in a circumferential direction of the wall portion 326, thereby further improving the draining effect.

In this embodiment, as shown in FIGS. 1 and 2, the impeller 100 may further include a cup portion 120 accommodating the motor 200; a lower board portion 130 extending radially outside from an outer circumferential edge of the cup portion 120; and an impeller portion 140 extending in the axial direction from the lower plate portion 130.

In the axial direction, a circuit board 500 being provided between the second housing 320 and the cup portion 120, an outer surface of the circuit board 500 being covered by a water-proof glue. Hence, the circuit board may be waterproof.

For example, as shown in FIGS. 1 and 2, the circuit board 500 may be disposed between the cup portion 120 and a surface of the platform portion 323 facing the inner side of the housing (an upper surface in FIGS. 1 and 2).

In this embodiment, multiple vanes 110 are disposed in a circumferential direction of the lower plate portion 130 in a spaced manner, the vanes 110 extending in the axial direction, and the number of the vanes being determined as actually demanded.

In this embodiment, the vanes 110, the lower board portion 130 and the impeller portion 140 may be integrally shaped. Hence, processes of manufacture and installation may be simplified.

In this embodiment, as shown in FIGS. 3 and 4, the second housing 320 may further have a guide portion 328 leading a wire to the exterior of the housing 300, and the base 321 may further have an opening portion 329.

For example, the guide portion 328 includes: a second groove portion 3281 formed in a surface of the base 321 facing the outer side of the housing 300 and radially extending outside from the opening portion 329; and a first group of hook portions 3282 including two hook-like components and provided on the wall portion 326 extending from the outer circumference of the base 321 in the axial direction.

Hence, the wire within the housing 300 may be easily and stably led to the outside.

Figure 5:
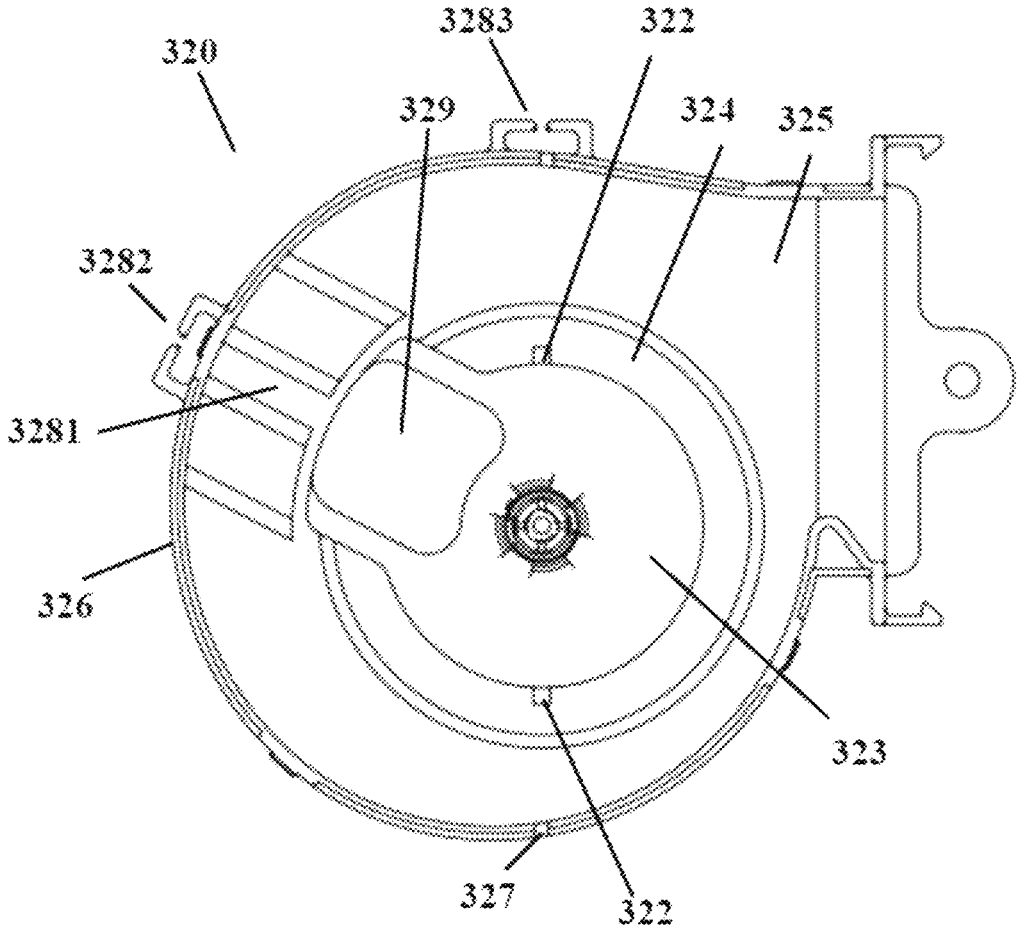
FIG. 5 is a bottom view of the second housing of the centrifugal fan of Embodiment 1 of this disclosure.

FIG. 5 is a bottom view of the second housing of the centrifugal fan of Embodiment 1 of this disclosure.

In this embodiment, as shown in FIG. 5, the guide portion 328 may further include: a second group of hook portions 3283 including two hook-like components and provided on the wall portion 326, the second group of hook portions 3283 and the first group of hook portions 3282 being provided at different positions in a circumferential direction of the second housing 320.

Hence, after passing the second groove portion 3281 and the first group of hook portions 3282, the wire within the housing 300 may further be led by the first group of hook portions 3282, thereby satisfying possible demands for use.

It can be seen from the above embodiment that by providing a water outlet connecting an interior and an exterior of a housing at a position closer to a radially inner side than an impeller, liquid at a bottom of the housing may be discharged quickly, and accumulation of the liquid may be avoided, thereby ensuring normal operation of the centrifugal fan. And furthermore, the water outlet may be formed through simple construction, and a process is simple.

Embodiment 2 provides an air supply device, including a centrifugal fan, the centrifugal fan being as described in Embodiment 1, which shall not be described herein any further.

In this embodiment, the air supply device may be used in various electrical equipment, such as a refrigerator, and an ice maker, etc.; however, this disclosure is not limited thereto.

It can be seen from the above embodiment that by providing a water outlet connecting an interior and an exterior of a housing at a position closer to a radially inner side than an impeller, liquid at a bottom of the housing may be discharged quickly, and accumulation of the liquid may be avoided, thereby ensuring normal operation of the centrifugal fan. And furthermore, the water outlet may be formed through simple construction, and a process is simple.

The embodiments of this disclosure are described above in detail with reference to the accompanying drawings, and the manners that the principle of this disclosure may be employed are pointed out. However, it should be understood that the implementation of this disclosure is not limited to the above embodiments, and may further include all variants, modifications, and equivalents, etc., within the protection scope of this disclosure.

What is claimed is:

1. A centrifugal fan, comprising:

an impeller rotatable about a central axis and including multiple vanes;

a motor located at a radially inner side of the impeller to drive the impeller; and a housing accommodating the impeller;

the housing including a first housing and a second housing;

the first housing including an axially opened air supply aperture at a radially outer side of the impeller;

the second housing including a base extending in a direction perpendicular or substantially perpendicular to an axial direction of the central axis; wherein the base includes at least one first water outlet connecting an interior and an exterior of the housing, the at least one first water outlet being located at a position closer to the radially inner side of the impeller than the radially outer side of the impeller;

the base further includes a platform to support the motor and a first groove at a radial outer side of an outer circumference of the platform; and the at least one first water outlet being provided at an intersection of the platform and the first groove.

2. The centrifugal fan according to claim 1, wherein the base includes multiple first water outlets located along a circumference of the base.

3. The centrifugal fan according to claim 2, wherein the multiple first water outlets are evenly distributed along the circumference of the base.

4. The centrifugal fan according to claim 1, wherein in the axial direction, the first water outlet has a sectional shape of a rectangle, or a triangle, or a trapezoid.

5. The centrifugal fan according to claim 1, wherein the base further includes a circumference provided at a radial outer side of the first groove;

in the axial direction, the platform is located at an outer side of the housing relative to the circumference, and the first groove is located at an inner side of the housing relative to the circumference.

6. The centrifugal fan according to claim 1, wherein in the axial direction, a height of the first groove is uneven relative to the platform.

7. The centrifugal fan according to claim 6, wherein a surface of the first groove facing the inner side of the housing includes a plane and a slope.

8. The centrifugal fan according to claim 1, wherein the second housing further includes a wall extending from an outer circumference of the base in the axial direction;

at least one second water outlet is provided at an end of the wall away from the base.

9. The centrifugal fan according to claim 1, wherein the impeller further comprises:

a cup accommodating the motor;

a lower plate extending radially outward from an outer circumferential edge of the cup; and an impeller portion extending in the axial direction from the lower plate to define the multiple vanes; wherein in the axial direction, a circuit board is provided between the second housing and the cup;

an outer surface of the circuit board is covered by a water-proof glue.

10. The centrifugal fan according to claim 9, wherein the lower plate and the impeller portion define an integral unitary structure.

11. The centrifugal fan according to claim 1, wherein the second housing further includes a guide leading a wire to the exterior of the housing.

12. The centrifugal fan according to claim 11, wherein the base further includes an opening; and the guide includes:

a second groove in a surface of the base facing the outer side of the housing and radially extending outside from the opening; and a first group of hooks including two hook-shaped components and provided on the wall extending from the outer circumference of the base in the axial direction.

13. The centrifugal fan according to claim 12, wherein the guide further includes:

a second group of hooks including two hook-shaped components and provided on the wall, the second group of hooks and the first group of hooks being provided at different positions in a circumferential direction of the second housing.

14. The centrifugal fan according to claim 1, wherein a section of an outer circumference of the air supply aperture of the first housing in the axial direction has a shape including an arc.

15. The centrifugal fan according to claim 1, wherein the centrifugal fan further includes a bearing accommodation integral with the second housing.

16. An air supply device of an electrical appliance comprising the centrifugal fan as claimed in claim 1.

* * * * *